US006621906B2

(12) United States Patent
Fukuchi et al.

(10) Patent No.: US 6,621,906 B2
(45) Date of Patent: Sep. 16, 2003

(54) SOUND FIELD GENERATION SYSTEM

(75) Inventors: Hiromi Fukuchi, Saitama (JP); Yoshiki Ohta, Saitama (JP)

(73) Assignee: Pioneer Corporation, Tokyo (JP)

( * ) Notice: Subject to any disclaimer, the term of this patent is extended or adjusted under 35 U.S.C. 154(b) by 255 days.

(21) Appl. No.: 09/842,640

(22) Filed: Apr. 27, 2001

(65) Prior Publication Data

US 2002/0044664 A1 Apr. 18, 2002

(30) Foreign Application Priority Data

Apr. 28, 2000 (JP) ..... P.2000-130623

(51) Int. Cl.[7] ..... H04R 5/00
(52) U.S. Cl. ..... 381/17; 381/63; 381/1
(58) Field of Search ..... 381/1, 63, 17, 381/18

(56) References Cited

U.S. PATENT DOCUMENTS 5,381,482 A * 1/1995 Matsumoto ..... 381/18
5,604,810 A 2/1997 Yanagawa
5,796,845 A * 8/1998 Serikawa ..... 381/63
6,035,045 A 3/2000 Fujita et al.

FOREIGN PATENT DOCUMENTS

EP 0 827 361 A2 3/1998
JP 8-130799 5/1996

* cited by examiner

*Primary Examiner*—Minsun Oh Harvey
(74) *Attorney, Agent, or Firm*—Sughrue Mion, PLLC

(57) ABSTRACT

A signal of a whole audio frequency band is input to input lines CHL and CHR having band-split digital band pass filters BFL1 to BFLn and BFR1 to BFRn, attenuators ATL1 to ATLn and ATR1 to ATRn, delay elements ZL1 to ZLn and ZR1 to ZRn, and adders 21 to 24, thereby causing speakers 25 and 26 to generate sounds. The reproduced sounds are picked up by microphones 27 and 28 placed at listening positions. The obtained pick-up signals PR and PL are passed through band-split digital band pass filters BFL1' to BFLn' and BFR1' to BFRn' which are set to the same bands as those of the band-split digital band pass filters BFL1 to BFRn, to generate test data DL1(t) to DLn(t) and DR1(t) to DRn(t). On a basis of the test data, an interaural correlation coefficient ρRL is calculated. Attenuation factors of the attenuators, and delay times of the delay elements are adjusted so as to approximate the interaural correlation coefficient ρRL to a target interaural correlation coefficient ρRL' which is previously acquired on a basis of a transfer function of a target reproduced sound field.

12 Claims, 10 Drawing Sheets

FIG. 6A

FIXING dL = 0

| | j = 1 | j = 2 | j = 3 | ···· | j = n |
|---|---|---|---|---|---|
| i = 1, dR = 0 | C11 | C12 | C13 | ···· | C1n |
| i = 2, dR = τ | C21 | C22 | C23 | ···· | C2n |
| i = 3, dR = 2τ | C31 | C32 | C33 | ···· | C3n |
| ⋮ | | | ⋮ | | |
| i = m, dR = (m - 1) τ | Cm1 | Cm2 | Cm3 | ···· | Cmn |

| j = 1 | j = 2 | j = 3 | ···· | j = n |
|---|---|---|---|---|
| T1 - C11 | T2 - C12 | T3 - C13 | ···· | Tn - C1n |
| T1 - C21 | T2 - C22 | T3 - C23 | ···· | Tn - C2n |
| T1 - C31 | T2 - C32 | T3 - C33 | ···· | Tn - C3n |
| ····· | ····· | ····· | ···· | ····· |
| T1 - Cm1 | T2 - Cm2 | T3 - Cm3 | ···· | Tn - Cmn |

(DIFFERENCES [ Tj - Cij ] STORED IN STORAGE REGION Q1)

FIG. 6B

FIXING dL = τ

| | j = 1 | j = 2 | j = 3 | ···· | j = n |
|---|---|---|---|---|---|
| i = 1, dR = 0 | C11 | C12 | C13 | ···· | C1n |
| i = 2, dR = τ | C21 | C22 | C23 | ···· | C2n |
| i = 3, dR = 2τ | C31 | C32 | C33 | ···· | C3n |
| ⋮ | | | ⋮ | | |
| i = m, dR = (m - 1) τ | Cm1 | Cm2 | Cm3 | ···· | Cmn |

| j = 1 | j = 2 | j = 3 | ···· | j = n |
|---|---|---|---|---|
| T1 - C11 | T2 - C12 | T3 - C13 | ···· | Tn - C1n |
| T1 - C21 | T2 - C22 | T3 - C23 | ···· | Tn - C2n |
| T1 - C31 | T2 - C32 | T3 - C33 | ···· | Tn - C3n |
| ····· | ····· | ····· | ···· | ····· |
| T1 - Cm1 | T2 - Cm2 | T3 - Cm3 | ···· | Tn - Cmn |

(DIFFERENCES [ Tj - Cij ] STORED IN STORAGE REGION Q2)

FIG. 6C

FIXING dL = 2τ

| | j = 1 | j = 2 | j = 3 | ···· | j = n |
|---|---|---|---|---|---|
| i = 1, dR = 0 | C11 | C12 | C13 | ···· | C1n |
| i = 2, dR = τ | C21 | C22 | C23 | ···· | C2n |
| i = 3, dR = 2τ | C31 | C32 | C33 | ···· | C3n |
| ⋮ | | | ⋮ | | |
| i = m, dR = (m - 1) τ | Cm1 | Cm2 | Cm3 | ···· | Cmn |

| j = 1 | j = 2 | j = 3 | ···· | j = n |
|---|---|---|---|---|
| T1 - C11 | T2 - C12 | T3 - C13 | ···· | Tn - C1n |
| T1 - C21 | T2 - C22 | T3 - C23 | ···· | Tn - C2n |
| T1 - C31 | T2 - C32 | T3 - C33 | ···· | Tn - C3n |
| ····· | ····· | ····· | ···· | ····· |
| T1 - Cm1 | T2 - Cm2 | T3 - Cm3 | ···· | Tn - Cmn |

(DIFFERENCES [ Tj - Cij ] STORED IN STORAGE REGION Q3)

FIG. 6D

FIXING dL = (m - 1) τ

| | j = 1 | j = 2 | j = 3 | ···· | j = n |
|---|---|---|---|---|---|
| i = 1, dR = 0 | C11 | C12 | C13 | ···· | C1n |
| i = 2, dR = τ | C21 | C22 | C23 | ···· | C2n |
| i = 3, dR = 2τ | C31 | C32 | C33 | ···· | C3n |
| ⋮ | | | ⋮ | | |
| i = m, dR = (m - 1) τ | Cm1 | Cm2 | Cm3 | ···· | Cmn |

| j = 1 | j = 2 | j = 3 | ···· | j = n |
|---|---|---|---|---|
| T1 - C11 | T2 - C12 | T3 - C13 | ···· | Tn - C1n |
| T1 - C21 | T2 - C22 | T3 - C23 | ···· | Tn - C2n |
| T1 - C31 | T2 - C32 | T3 - C33 | ···· | Tn - C3n |
| ····· | ····· | ····· | ···· | ····· |
| T1 - Cm1 | T2 - Cm2 | T3 - Cm3 | ···· | Tn - Cmn |

(DIFFERENCES [ Tj - Cij ] STORED IN STORAGE REGION Qm)

FIG. 7A

| dL | dR | j = 1 | j = 2 | j = 3 | ····· | j = n | |
|---|---|---|---|---|---|---|---|
| 0 | 0 | T1 - C11 | T2 - C12 | T3 - C13 | ····· | Tn - C1n | Q1 |
| | τ | T1 - C21 | T2 - C22 | T3 - C23 | ····· | Tn - C2n | |
| | 2τ | T1 - C31 | T2 - C32 | T3 - C33 | ····· | Tn - C3n | |
| | ····· | ····· | ····· | ····· | ····· | ····· | |
| | (m - 1) τ | T1 - Cm1 | T2 - Cm2 | T3 - Cm3 | ····· | Tn - Cmn | |
| τ | 0 | T1 - C11 | T2 - C12 | T3 - C13 | ····· | Tn - C1n | Q2 |
| | τ | T1 - C21 | T2 - C22 | T3 - C23 | ····· | Tn - C2n | |
| | 2τ | T1 - C31 | T2 - C32 | T3 - C33 | ····· | Tn - C3n | |
| | ····· | ····· | ····· | ····· | ····· | ····· | |
| | (m - 1) τ | T1 - Cm1 | T2 - Cm2 | T3 - Cm3 | ····· | Tn - Cmn | |
| 2τ | 0 | T1 - C11 | T2 - C12 | T3 - C13 | ····· | Tn - C1n | Q3 |
| | τ | T1 - C21 | T2 - C22 | T3 - C23 | ····· | Tn - C2n | |
| | 2τ | T1 - C31 | T2 - C32 | T3 - C33 | ····· | Tn - C3n | |
| | ····· | ····· | ····· | ····· | ····· | ····· | |
| | (m - 1) τ | T1 - Cm1 | T2 - Cm2 | T3 - Cm3 | ····· | Tn - Cmn | |
| (m - 1) τ | 0 | T1 - C11 | T2 - C12 | T3 - C13 | ····· | Tn - C1n | Qm |
| | τ | T1 - C21 | T2 - C22 | T3 - C23 | ····· | Tn - C2n | |
| | 2τ | T1 - C31 | T2 - C32 | T3 - C33 | ····· | Tn - C3n | |
| | ····· | ····· | ····· | ····· | ····· | ····· | |
| | (m - 1) τ | T1 - Cm1 | T2 - Cm2 | T3 - Cm3 | ····· | Tn - Cmn | |

FIG. 7B

| ZL1 | ZL2 | ZL3 | ····· | ZLn |
|---|---|---|---|---|
| τ | (m - 1) τ | 0 | ····· | 2τ |

FIG. 7C

| ZR1 | ZR2 | ZR3 | ····· | ZRn |
|---|---|---|---|---|
| 2τ | τ | τ | ····· | 0 |

FIG. 8A

| AL | AR | j = 1 | j = 2 | j = 3 | ····· | j = n | |
|---|---|---|---|---|---|---|---|
| 0 | 0 | T1 - C11 | T2 - C12 | T3 - C13 | ····· | Tn - C1n | Q1 |
| | -G | T1 - C21 | T2 - C22 | T3 - C23 | ····· | Tn - C2n | |
| | -2G | T1 - C31 | T2 - C32 | T3 - C33 | ····· | Tn - C3n | |
| | ····· | ····· | ····· | ····· | ····· | ····· | |
| | - (p - 1) G | T1 - Cp1 | T2 - Cp2 | T3 - Cp3 | ····· | Tn - Cpn | |
| -G | 0 | T1 - C11 | T2 - C12 | T3 - C13 | ····· | Tn - C1n | Q2 |
| | -G | T1 - C21 | T2 - C22 | T3 - C23 | ····· | Tn - C2n | |
| | -2G | T1 - C31 | T2 - C32 | T3 - C33 | ····· | Tn - C3n | |
| | ····· | ····· | ····· | ····· | ····· | ····· | |
| | - (p - 1) G | T1 - Cp1 | T2 - Cp2 | T3 - Cp3 | ····· | Tn - Cpn | |
| -2G | 0 | T1 - C11 | T2 - C12 | T3 - C13 | ····· | Tn - C1n | Q3 |
| | -G | T1 - C21 | T2 - C22 | T3 - C23 | ····· | Tn - C2n | |
| | -2G | T1 - C31 | T2 - C32 | T3 - C33 | ····· | Tn - C3n | |
| | ····· | ····· | ····· | ····· | ····· | ····· | |
| | - (p - 1) G | T1 - Cp1 | T2 - Cp2 | T3 - Cp3 | ····· | Tn - Cpn | |
| - (p - 1) G | 0 | T1 - C11 | T2 - C12 | T3 - C13 | ····· | Tn - C1n | Qm |
| | -G | T1 - C21 | T2 - C22 | T3 - C23 | ····· | Tn - C2n | |
| | -2G | T1 - C31 | T2 - C32 | T3 - C33 | ····· | Tn - C3n | |
| | ····· | ····· | ····· | ····· | ····· | ····· | |
| | - (p - 1) G | T1 - Cp1 | T2 - Cp2 | T3 - Cp3 | ····· | Tn - Cpn | |

FIG. 8B

| ATL1 | ATL2 | ATL3 | ····· | ATLn |
|---|---|---|---|---|
| 0 | -2G | - (p - 1) G | ····· | 0 |

FIG. 8C

| ATR1 | ATR2 | ATR3 | ····· | ATRn |
|---|---|---|---|---|
| - (p - 1) G | -2G | -G | ····· | -G |

SOUND FIELD GENERATION SYSTEM

BACKGROUND OF THE INVENTION

1. Field of the Invention

The present invention relates to a sound field generation system that generates a sound field space where the listener can receive spatial sound impression similar to that obtained in the case where the listener listens to music in, for example, a concert hall.

2. Description of the Related Art

As a sound field generation system of this kind, known is a sound field generation apparatus which is disclosed in JP-A-8-130799.

As shown in FIG. 10A, the sound field generation apparatus of the related art comprises reverberation generating circuits 1 and 2 which are called SFC processing circuits, filter circuits 3 and 4, adders 5 and 6, and amplifiers 7 and 8, and is configured so as to operate two speakers 9 and 10 to generate sounds, thereby generating a reproduction sound field where spatial sound impression can be obtained.

Each of the reverberation generating circuits 1 and 2 comprises a delaying circuit 13 having multistage delay elements D1 to Dn shown in FIG. 10B. Plural delayed outputs with respect to an input signal Sin are added to one another in a predetermined combination relationship, to generate signals for two channels which are provided with reverberation characteristics.

The reverberation generating circuits 1 and 2 further comprise an attenuator and an all-pass filter. The amplitudes and phase characteristics of the signals for two channels are adjusted, so that a right-channel signal SR1 and a left-channel signal SL1 are generated and supplied to the adders 5 and 6.

Each of the filter circuits 3 and 4 is configured by a variable filter which variably adjusts the gain of the right- or left-channel signals SR1 or SL1 in the audio frequency band as schematically shown in FIG. 10C. The output of the filter circuit 3 is supplied to the adders 5 and 6, that of the filter circuit 4 is supplied to the adder 6, and an inverted output of the filter circuit 4 is supplied to the adder 5.

According to this configuration, the adders 5 and 6 output right- and left-channel signals SR2 and SL2 which are similar to those recorded in, for example, a specific concert hall, and the signals SR2 and SL2 are supplied to the speakers 9 and 10 via the amplifiers 7 and 8, respectively, thereby generating a reproduction sound field where the listener can receive spatial sound impression similar to that obtained in the case where the listener listens to music in the specific concert hall.

Microphones 11 and 12 pick up reproduced sounds which reach from the speakers 9 and 10 to the ears of the listener. On the basis of obtained pick-up signals PR and PL, an interaural correlation coefficient ρRL is acquired. The frequency characteristics of the filter circuits 3 and 4 are adjusted so that the difference between an interaural correlation coefficient ρRL' which is previously acquired from the actual transfer function (frequency characteristics) of the specific concert hall, and the interaural correlation coefficient ρRL becomes zero.

The transfer function (frequency characteristics) of a listening room or the like of the listener is different from that of the specific concert hall. Therefore, the frequency characteristics of the filter circuits 3 and 4 are adjusted so as to approximate the interaural correlation coefficient ρRL of the reproduction sound field which is actually generated in the listening room or the like to the interaural correlation coefficient ρRL' of the specific concert hall, so that, even in a listening room or the like of the listener, a reproduction sound field where spatial sound impression similar to that obtained in the specific concert hall is obtained is generated.

In the sound field generation apparatus according to the related art, the frequency characteristics of the filter circuits 3 and 4 are adjusted in the following manner.

First, it is assumed that the interaural correlation coefficient ρRL' which is previously obtained from the actual transfer function (frequency characteristics) of the specific concert hall has the characteristics shown in FIG. 11A. The transfer functions of the reverberation generating circuits 1 and 2 are previously set so as to coincide with the interaural correlation coefficient ρRL'.

As shown in FIG. 11B, the passbands of the filter circuits 3 and 4 are set to a narrow band W1, and a stationary random signal of the narrow band is supplied as the input signal Sin for adjustment, thereby causing the speakers 9 and 10 to generate reproduced sounds based on the stationary random signal of the narrow band. The microphones 11 and 12 pick up the reproduced sounds, and the interaural correlation coefficient ρRL is acquired on the basis of the obtained pick-up signals PR and PL. Thereafter, the difference between the interaural correlation coefficients ρRL' and ρRL in the narrow band W1 is acquired.

Similarly, the passbands of the filter circuits 3 and 4 are sequentially switched to narrow bands W2, W3, . . . , Wk in this sequence, the speakers 9 and 10 are caused at each of the switching operations to generate reproduced sounds based on the stationary random signal of the narrow band, and the differences between the interaural correlation coefficients ρRL' and ρRL in the narrow bands W2, W3, . . . , Wk are acquired.

The gains of the filter circuits 3 and 4 for each of the narrow bands W1, W2, W3, . . . , Wk are adjusted so that the difference between the interaural correlation coefficient ρRL which is actually acquired for each of the narrow bands W1, W2, W3, . . . , Wk, and the interaural correlation coefficient ρRL' of the concert hall or the like becomes zero, thereby adjusting the frequency characteristics of the filter circuits 3 and 4 in the whole audio frequency band. Namely, the frequency characteristics of the filter circuits 3 and 4 are adjusted in consideration of the transfer function (frequency characteristics) of a listening room or the like of the listener.

When the frequency characteristics of the filter circuits 3 and 4 are adjusted in this way, the adders 5 and 6 outputs the signals SR2 and SL2 which are obtained by finely adjusting the signals SR1 and SL1 that have been provided with reverberation characteristics of the listening room or the like, on the basis of the output signals of the filter circuits 3 and 4. The speakers 9 and 10 are caused to generate sounds on the basis of the signals SR2 and SL2, with the result that, even in the listening room or the like of the listener, a reproduction sound field where spatial sound impression similar to that obtained in the specific concert hall is obtained can be generated.

When a stationary random signal of the narrow band is supplied as the input signal Sin for adjustment and the passbands of the filter circuits 3 and 4 are set in the sequence of the narrow bands W1, W2, W3, . . . , Wk as described above, the interaural correlation coefficient ρRL is acquired with including signal components in the overlapping portions of the narrow bands W1, W2, W3, . . . , Wk as indicated by the hatched areas in FIG. 11C.

When the narrow bands W1 and W2 are considered, for example, since the bands overlap with each other, the interaural correlation coefficient ρRL, which is acquired on the basis of the stationary random signal of the narrow band W1, contains influences of the stationary random signal in the narrow band W2, and the interaural correlation coefficient ρRL, which is acquired on the basis of the stationary random signal of the narrow band W, contains influences of the stationary random signal in the narrow band W1. Also the interaural correlation coefficients ρRL which are acquired for the other narrow bands W2, W3, . . . , Wk contain similar influences, respectively.

Even when the frequency characteristics of the filter circuits 3 and 4 are adjusted so as to perform approximation to the interaural correlation coefficient ρRL' of the specific concert hall on the basis of the interaural correlation coefficient ρRL which is actually acquired, therefore, an approximation error may occur. As a result, there arises a problem in that a case may occur where, even when the input signal Sin of the actual audio frequency band is supplied to sound the speakers 9 and 10, the reproduction sound field cannot be approximated to the specific concert hall with sufficiently high accuracy.

SUMMARY OF THE INVENTION

The invention has been conducted in view of the problem of the related art. It is an object of the invention to provide a sound field generation system of a novel configuration which can generate a target sound field space where spatial sound impression simulating that obtained in, for example, a specific concert hall is obtained, with accuracy that is higher than that of the related art.

In order to attain the object, the invention provides a sound field generation system performing interaural correction on at least one input signal to generate a target reproduction sound field, comprising:

at least two sound releasing units;

two input lines through which the one input signal is supplied to the sound releasing units;

a plurality of first band splitting units which are disposed in at least one of the two input lines, and which have different bands from each other;

a plurality of delaying units which are disposed in the first band splitting units, respectively;

a sound picking unit adapted to pick up sounds released from the sound releasing units, at listening positions corresponding to both ears;

a plurality of second band splitting units adapted to band-split outputs of the sound picking units with the same bandwidths as those of the first band splitting units;

a calculating unit adapted to calculate interaural correlation on a basis of band-split outputs from the second band splitting units; and a controlling unit adapted to control delaying amounts of the delaying units on a basis of a calculation result of the calculating unit.

According to this configuration, the input signal is supplied to the sound releasing units through the first band splitting units and the delaying units, and reproduced sounds are then generated. The sound picking unit at the listening positions pick up the reproduced sounds, and the outputs of the sound picking units are band-split by the second band splitting units. The calculating unit calculates interaural correlation on the basis of each of band-split outputs which have undergone the band split. Based on a result of the calculation, the controlling unit controls the delaying amounts of each of delaying units which is disposed in each of first band splitting units. When the delaying amounts of the delaying units are controlled in this way, a target reproduction sound field can be generated by the reproduced sounds released from the sound releasing units.

When the first and second band splitting units have the same band width, the result of the calculation of the interaural correlation contains no influence between the split bands. When the delaying amounts of the delaying units which are respectively disposed in the first band splitting units are controlled on the basis of the calculation result, the target reproduction sound field can be realized with high accuracy.

The system is configured so that attenuation factor adjusting units is disposed in each of the delaying units and the attenuation factors of the attenuation factor adjusting units are controlled on the basis of the calculation result of the calculating unit. According to this configuration, not only the delaying amounts of the input signal for the respective bands which are set by the first band splitting units, but also the amplitudes are controlled. Therefore, the target reproduction sound field can be generated with higher accuracy.

The invention provides also a sound field generation system performing interaural correction on at least one input signal to generate a target reproduction sound field, comprising:

at least two sound releasing units;

two input lines through which the one input signal is supplied to the sound releasing units;

a plurality of first band splitting units which are disposed in at least one of the two input lines, and which have different bands from each other;

a plurality of delaying units which are disposed in the first band splitting units, respectively;

a storage unit adapted to store transfer functions of spaces between the sound releasing units and listening positions at which reproduced sounds output from the sound releasing units are received, and which correspond to both ears, respectively;

a calculating unit adapted to perform a modulation process on the signal supplied from the input lines toward the sound releasing units on a basis of data indicative of the transfer functions, thereby generating modulated data corresponding to the reproduced sounds at the listening positions, the calculating unit adapted to calculate interaural correlation at the listening positions on a basis of the modulated data; and a controlling unit adapted to control delaying amounts of the delaying units on a basis of a calculation result of the calculating unit.

According to this configuration, data (modulated data) of the sounds reaching to the listening positions are obtained by performing a modulation process on signals supplied from the input lines toward the sound releasing units on the basis of data indicative of the transfer functions (frequency characteristics) of the spaces between the sound releasing units and the sound picking unit. That is, data of sounds, which are released from the sound releasing units and reach to the listening positions, are acquired as pseudo sound data (modulated data) by so-called simulation. Furthermore, interaural correlation is calculated on the basis of the pseudo sound data (modulated data), and the delaying amounts of the delaying units are optimized based on a result of the calculation. Even when sounds released from the sound releasing units are not actually picked up at the listening positions, therefore, the delaying amounts of the delaying units can be optimized.

Furthermore, the system is characterized in that a plurality of attenuation factor adjusting units are disposed in each of the delaying units and the attenuation factors of the attenuation factor adjusting units are controlled on the basis of the calculation result of the calculating unit. According to this configuration, not only the delaying amounts of the input signal for the respective bands which are set by the first band splitting units, but also the amplitudes are controlled by simulation. Therefore, the target reproduction sound field can be generated with higher accuracy.

BRIEF DESCRIPTION OF THE DRAWINGS

FIG. 6 are a views showing interaural correlation coefficients and differences which are calculated in optimizing adjustment of delay times of delaying circuits.

FIG. 7 are a views showing a method of optimally adjusting the delay times of the delaying circuits.

FIG. 8 are a views showing a method of optimally adjusting interaural correlation coefficients, differences, and attenuation factors which are calculated in optimizing adjustment of attenuation factors of attenuator circuits.

DETAILED DESCRIPTION OF THE PREFERRED EMBODIMENT

Figure 1:
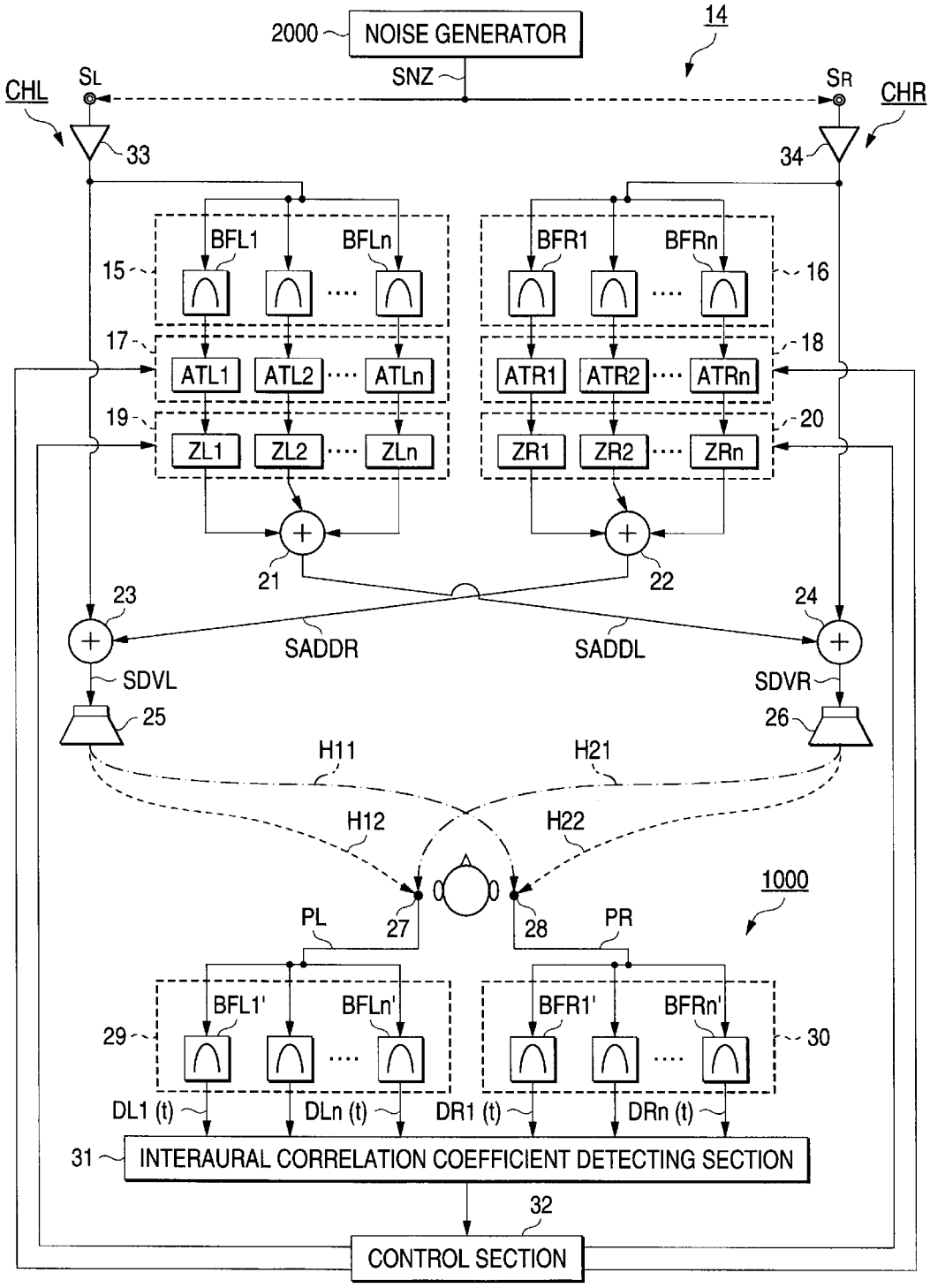
FIG. 1 is a block diagram showing the configuration of a sound field generation system of an embodiment.

Hereinafter, an embodiment of the sound field generation system of the invention will be described with reference to the accompanying drawings. FIG. 1 is a block diagram showing a configuration of a sound field generation system 14 of the embodiment, and shows as a typical example a configuration in the case where left and right or two-channel speakers 25 and 26 which are disposed in a living room or the like of the user, and which serve as the sound releasing unit are caused to produce sounds on the basis of left and right or two-channel input audio signals SL and SR.

Referring to FIG. 1, the sound field generation system 14 comprises: two so-called input lines CHL and CHR for supplying the input audio signals SL and SR to the speakers 25 and 26; an adjusting circuit 1000 for picking up reproduced sounds generated by the speakers 25 and 26, and feedback controlling characteristics of attenuator circuits 17 and 18 and delaying circuits 19 and 20 which are disposed in the input lines CHL and CHR; and a noise generator 2000.

The input lines CHL and CHR comprise: digital amplifiers 33 and 34 for left and right or two channels which are configured by a digital signal processor (DSP), and to which the input audio signals SL and SR that have been analog/digital-converted; filter circuits 15 and 16; the attenuator circuits 17 and 18; the delaying circuits 19 and 20; and adders 21, 22, 23, and 24.

The filter circuit 15 is configured by a plurality or n number of band-split digital band pass filters BFL1 to BFLn to which the input audio signal SL is supplied in parallel via the amplifier 33. The band pass filters BFL1 to BFLn serving as the first band splitting unit are allocated to split bands which are obtained by splitting the whole audio frequency band into an n number of bands. Specifically, the filter circuit is configured by n(=20) secondary IIR filters.

In the same manner as the filter circuit 15, the filter circuit 16 is configured by a plurality or n number of band-split digital band pass filters BFR1 to BFRn. The band pass filters BFR1 to BFRn are allocated to split bands which are obtained by splitting the whole audio frequency band into an n (=20) number of bands. Namely, the band pass filters BFR1 to BFRn are set to the same split bands as those of the band pass filters BFL1 to BFLn.

The attenuator circuit 17 is configured by a plurality or n number of digital attenuators ATL1 to ATLn which respectively attenuate signals from the band pass filters BFL1 to BFLn and output attenuated signals. The attenuation factors of the digital attenuators ATL1 to ATLn can be individually adjusted in a variable manner in accordance with a control by a control section 32 which will be described later.

In the same manner as the attenuator circuit 17, the attenuator circuit 18 is configured by a plurality or n number of digital attenuators ATR1 to ATRn which respectively attenuate signals from the band pass filters BFR1 to BFRn in accordance with a control by the control section 32 which will be described later, and output attenuated signals.

The delaying circuit 19 comprises a plurality or n number of digital delay elements ZL1 to ZLn, individually delays the signals from the band pass filters BFL1 to BFLn, and outputs delayed signals.

In the same manner as the delaying circuit 19, the delaying circuit 20 comprises a plurality or n number of digital delay elements ZR1 to ZRn, and individually delays the signals from the band pass filters BFR1 to BFRn, and outputs delayed signals.

The delaying amounts (delay times) of the delay elements ZL1 to ZLn and ZR1 to ZRn can be adjusted in accordance with instructions from the control section 32 which will be described later.

The adder 21 adds the n signals output from the delay elements ZL1 to ZLn together, and supplies a signal SADDL obtained by the addition to the adder 24.

The adder 22 adds the n signals output from the delay elements ZR1 to ZRn together, and supplies a signal SADDR obtained by the addition to the adder 23.

The adder 23 adds the input audio signal SL supplied via the amplifier 33, and the signal SADDR, and supplies a signal SDVL obtained by the addition to the speaker 25.

The adder 24 adds the input audio signal SR supplied via the amplifier 34, and the signal SADDL, and supplies a signal SDVR obtained by the addition to the speaker 26.

Although not shown, an A/D converter and an output power amplifier are connected between the adder 23 and the speaker 25 so that the signal SDVL which has undergone the digital signal processing is converted into an analog signal and then power-amplified to be supplied to the speaker 25. Similarly, an A/D converter and an output power amplifier are connected between the adder 24 and the speaker 26 so that the signal SDVR is converted into an analog signal and then power-amplified to be supplied to the speaker 26.

The noise generator 2000 outputs uncorrelated noises SNZ of a uniform level over the whole audio frequency band, in sound field adjustment which will be described later, and supplies the noises to the amplifiers 33 and 34 via a switching circuit which is not shown. Specifically, in normal audio reproduction, the input audio signals SL and SR are supplied to the amplifiers 33 and 34, and, in the sound field adjustment which will be described later, the uncorrelated noises SNZ are supplied in place of the input audio signals SL and SR to the amplifiers 33 and 34.

The adjusting circuit 1000 is configured by: filter circuits 29 and 30, and an interaural correlation coefficient detecting section 31 which are formed by a digital signal processor (DSP); and the control section 32 comprising a microprocessor (MPU). The circuit further comprises microphones 27 and 28 which pick up reproduced sounds released from the speakers 25 and 26 at respective listening positions (substantially corresponding to the positions of the ears) of the listener.

The filter circuit 29 is configured in the same manner as the filter circuit 15 which is disposed in the input line CHL. Namely, the filter circuit 29 is configured by a plurality or n number of band-split digital band pass filters BFL1' to BFLn' having the same characteristics as those of the band-split digital band pass filters BFL1 to BFLn of the filter circuit 15.

A pick-up signal PL which is output from the microphone 27 is supplied in parallel to the band pass filters BFL1' to BFLn' serving as the second band splitting unit.

Similarly, the filter circuit 30 has the same configuration as the filter circuit 16 which is disposed in the input line CHR, and is configured by a plurality or n number of band-split digital band pass filters BFR1' to BFRn' having the same characteristics as those of the band-split digital band pass filters BFR1 to BFRn of the filter circuit 16.

A pick-up signal PR which is output from the microphone 28 is supplied in parallel to the band pass filters BFR1' to BFRn' serving as the second band splitting unit.

Although not shown, the pick-up signals PL and PR are analog/digital-converted by A/D converters, and then supplied to the filter circuits 29 and 30.

Figure 2:
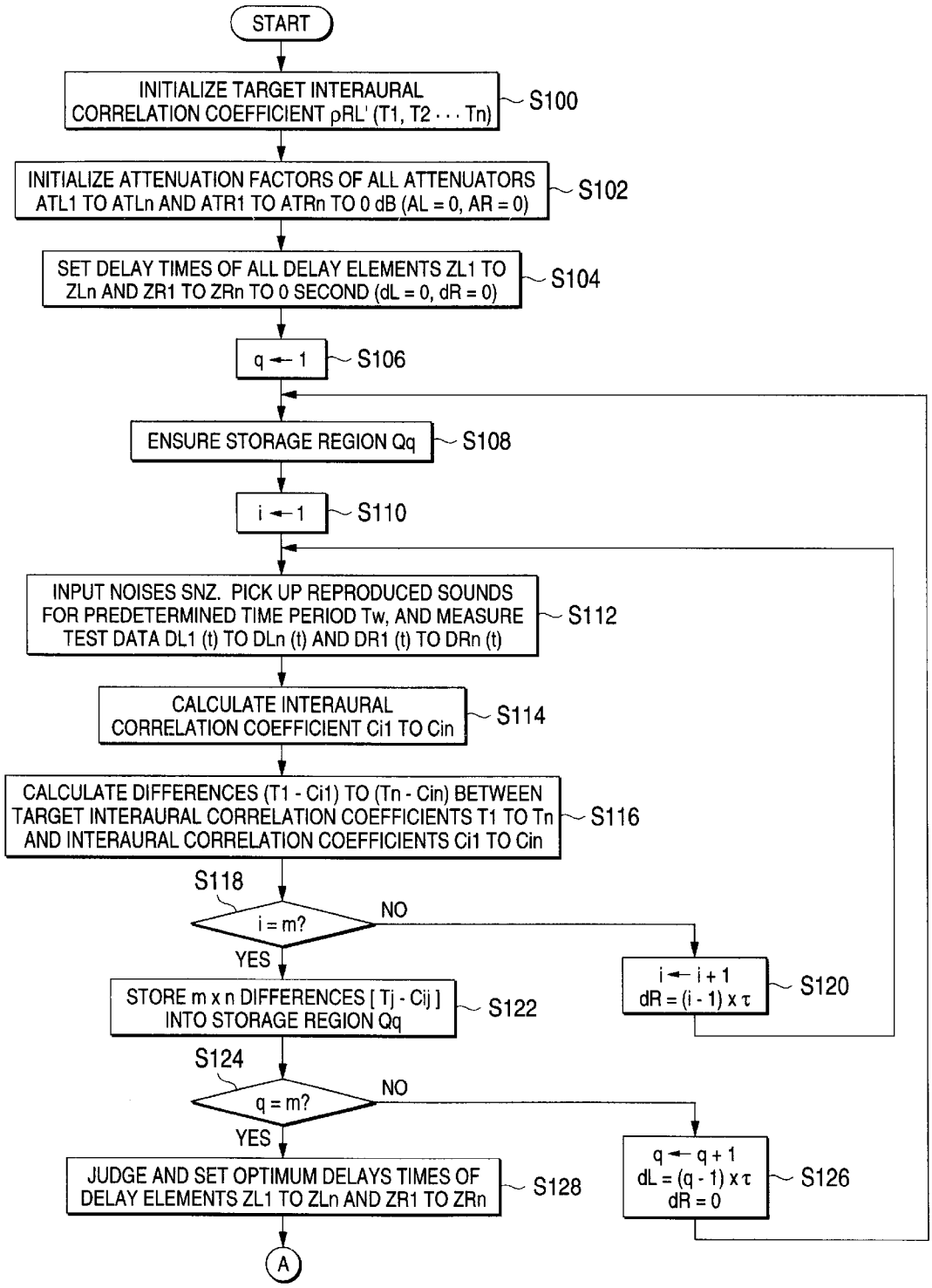
FIG. 2 is a flowchart illustrating the operation of the sound field generation system of the embodiment.
Figure 3:
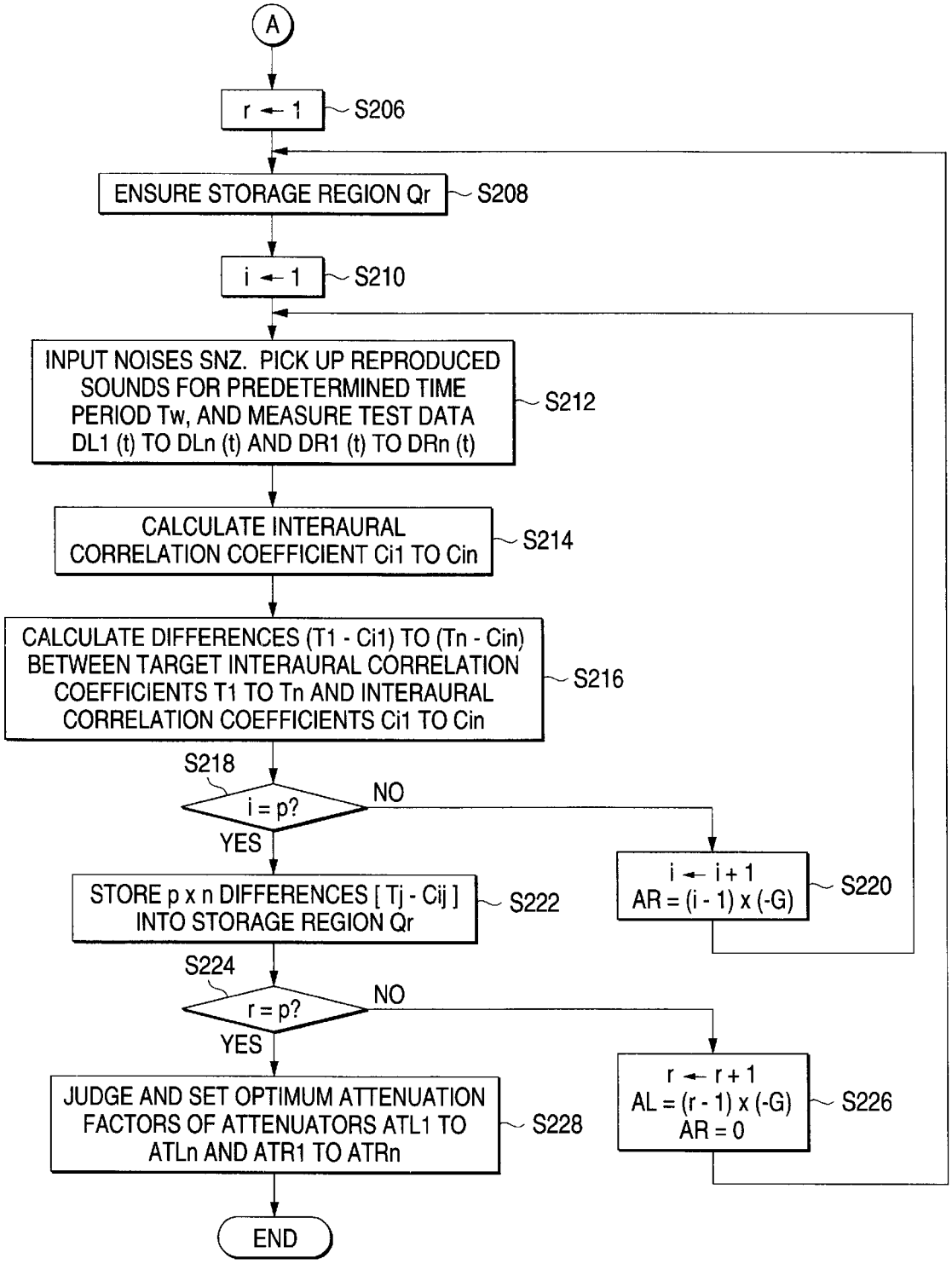
FIG. 3 is a flowchart further illustrating the operation of the sound field generation system of the embodiment.

Next, the operation of the thus configured sound field generation system 14 in the sound field adjustment will be described with reference to flowcharts of FIGS. 2 and 3. FIG. 2 shows the operation of adjusting the delay times of the delay elements ZL1 to ZLn and ZR1 to ZRn disposed in the delaying circuits 19 and 20, and FIG. 3 shows that of adjusting the attenuation factors of the digital attenuators ATL1 to ATLn and ATR1 to ATRn disposed in the attenuator circuits 17 and 18.

When the user operates a remote controller (not shown) to give the control section 32 instructions for performing adjustment so that a sound field where spatial sound impression similar to that in a specific concert hall is obtained is generated in the living room or the like of the user, the sound field adjustment process shown in FIG. 2 is started.

First, in step S100, the control section 32 initializes the interaural correlation coefficients ρRL' (T1, T2, . . . , Tn) of a specific concert hall or the like which is designated by the user. The control section 32 previously stores data of interaural correlation coefficients ρRL' which are acquired from transfer functions (frequency characteristics) of, for example, famous concert halls, and also data of an interaural correlation coefficient ρRL' of each of plural concert halls. When a specific one of these concert halls is selectively designated by the user, the interaural correlation coefficient ρRL' (T1, T2, . . . , Tn) of the designated specific concert hall is initialized.

Figure 4:
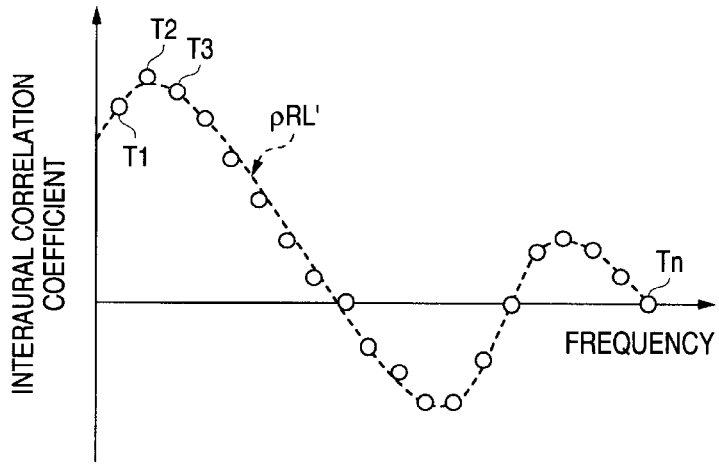
FIG. 4 is a characteristic diagram schematically showing an example of a target interaural correlation coefficient.

The initialized interaural correlation coefficient ρRL' (T1, T2, . . . , Tn) is called the target interaural correlation coefficient, and, as shown in FIG. 4, is a set of coefficient data T1, T2, . . . , Tn corresponding to the center frequencies of the band-split digital band pass filters BFL1' to BFLn' and BFR1' to BFRn' which are disposed at the n number in the filter circuits 29 and 30.

Next, in step S102, the attenuation factors of all the digital attenuators ATL1 to ATLn and ATR1 to ATRn are initialized to 0 dB, and, in step S104, the delay times of all the delay elements ZL1 to ZLn and ZR1 to ZRn are initialized to 0 sec. For the sake of convenience in description, the attenuation factors (0 dB) of the digital attenuators ATL1 to ATLn are indicated as AL=0, the attenuation factors (0 dB) of the digital attenuators ATR1 to ATRn are indicated as AR=0, the delay times (0 sec.) of the delay elements ZL1 to ZLn are indicated as dL=0, and the delay times (0 sec.) of the delay elements ZR1 to ZRn are indicated as dR=0.

Then, in step S106, a variable q is set to "1" in order to designate the first storage region Q1 of an m number of storage regions Q1 to Qm which will be described later.

Next, in step S108, the initial storage region Qk (=Q1) is ensured in a data storage region (not shown) which is disposed in the control section 32.

Next, in step S110, a variable i is set to "1". The variable i indicates the order in the case where the delay times of the delay elements ZR1 to ZRn are changed in a step of a predetermined value τ. When i=1, dR=0 is attained. The variable q designates the m number of storage regions Q1 to Qm, and indicates the order in the case where the delay times of the delay elements ZL1 to ZLn are changed in a step of the predetermined value τ. When q=1, dL=0 is attained.

Thereafter, in step S112, the noise generator 2000 supplies the uncorrelated noises SNZ of the whole audio frequency band to the amplifiers 33 and 34, to cause the speakers 25 and 26 to generate sounds. During a predetermined time period Tw, the microphones 27 and 28 pick up reproduced sounds released from the speakers 25 and 26. Then, test data DL1(t) to DLn(t) and DR1(t) to DRn(t) which are band-split by passing the pick-up signals PL and PR that are obtained as a result of the picking operation, through the band-split digital band pass filters BFL1' to BFLn' and BFR1' to BFRn' are supplied to the interaural correlation coefficient detecting section 31.

Figure 5:
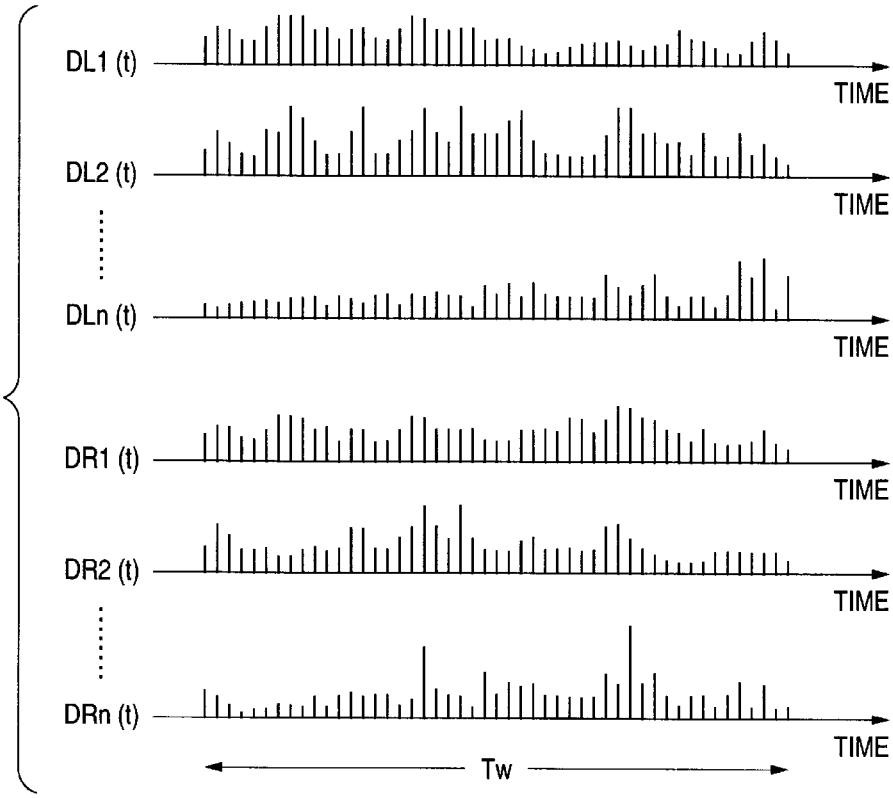
FIG. 5 is a timing chart schematically showing plural test data which are supplied to an interaural correlation coefficient detecting section.

The variable t in the test data DL1(t) to DLn(t) and DR1(t) to DRn(t) indicates that the data are obtained at each reciprocal (sampling period) 1/f of the sampling frequency f which is set on the basis of the sampling theorem. As schematically shown in FIG. 5, when the reproduced sounds are picked up for the predetermined time period Tw, therefore, the test data DL1(t) consist of a Tw×f number of data, also the test data DR1(t) consist of a Tw×f number of data, and also the other DL2(t) to DLn(t) and DR2(t) to DRn(t) consist of a Tw×f number of data, respectively.

As shown in FIG. 1, the test data DL1(t) to DLn(t) are data of sounds which are modulated by spatial transfer functions H12 and H21 between the speakers 25 and 26 and the microphone 27, and the test data DR1(t) to DRn(t) are data of sounds which are modulated by spatial transfer functions H11 and H22 between the speakers 25 and 26 and the microphone 28.

Next, in step S114, the interaural correlation coefficient detecting section 31 calculates an interaural correlation coefficient C11 between the test data DL1(t) and DR1(t), and an interaural correlation coefficient C12 between the test data DL1 (t) and DR1(t) by Ex. (1) below. Then, calculations are conducted in the same manner as described above until an interaural correlation coefficient Cln between the test data DLn(t) and DRn(t) is calculated.

$$Cij = \frac{< DLij(t) \cdot DRij(t) >}{\sqrt{< |DLij(t)|^2 >}\sqrt{< |DRij(t)|^2 >}} \quad (1)$$

In Ex. (1) above, the variable j of the interaural correlation coefficient Cij indicates the order of 1 to n of the band-split digital band pass filters BFL1' to BFLn' and BFR1' to BFRn', and the variable i indicates the order in the case where the delay times of the delay elements ZR1 to ZRn are changed in a step of the predetermined value τ. The symbol <> in Ex. (1) indicates an ensemble mean.

As a result, in an initial step S114, interaural correlation coefficients (C11, C12, . . . , Cln) in the case where i=1 and both the delay times dL and dR of the delay elements ZL1 to ZLn and ZR1 to ZRn are set to 0 sec. are obtained as shown in the left side of FIG. 6A.

Next, in step S116, differences (T1−C11), (T2−C 12), . . . , (Tn−Cln) between the target interaural correlation coefficients (T1, T2, . . . , Tn) and the interaural correlation coefficients (C11, C12, . . . , Cln) obtained in step S114 are calculated. Namely, as shown in the right side of FIG. 6A, the differences (T1−C11), (T2−C12), . . . , (Tn−Cln) corresponding to the interaural correlation coefficients (C11, C12, . . . , Cln) are obtained.

Then, it is judged in step S118 whether the variable i is m or i=m or not. If No, the control proceeds to step S120 to increment the variable i by one, and increase the delay times dR of the delay elements ZR1 to ZRn by τ. Thereafter, the processes subsequent to step S112 are repeated.

When the processes of steps S112 to S120 are repeated in this way until i=m is judged in step S118, interaural correlation coefficients (C11, C12, . . . , Cln) to (Cm1, Cm2, . . . , Cmn) in the case where the delay times dL of the delay elements ZL1 to ZLn are fixed to 0 sec. and the delay times dR of the delay elements ZR1 to ZRn are gradually increased from 0 sec. in a step of τ sec. are obtained as shown in the left side of FIG. 6A. Furthermore, differences [(T1−C11), (T2−C12), . . . , (Tn−Cln)] to [(T1−Cm1), (T2−Cm2), . . . , (Tn−Cmn)] corresponding to the interaural correlation coefficients (C11, C12, . . . , Cln) to (Cm1, Cm2, . . . , Cmn) are obtained as shown in the right side of FIG. 6A.

If it is judged in step S118 that i=m, the differences [(T1−C11), (T2−C12), . . . , (Tn−Cln)] to [(T1−Cm1), (T2−Cm2), . . . , (Tn−Cmn)] are stored in step S122 into the storage region Q1.

Then, it is judged in step S124 whether the variable q is m or q=m or not. If No, the control proceeds to step S126 where the variable q is incremented by one, the delay times dL of the delay elements ZL1 to ZLn are increased by τ, and the delay times dR of the delay elements ZR1 to ZRn are fixed to 0 sec. Thereafter, the processes subsequent to step S108 are repeated.

When the processes of steps S108 to S126 are repeated in this way until q=m is judged in step S124, the interaural correlation coefficients and the differences shown in FIG. 6B are obtained in the case where the delay times dL of the delay elements ZL1 to ZLn are fixed to τ sec. and the delay times dR of the delay elements ZR1 to ZRn are gradually increased from 0 sec. in a step of τ sec., and the interaural correlation coefficients and the differences shown in FIG. 6C are obtained in the case where the delay times dL of the delay elements ZL1 to ZLn are fixed to 2×τ sec. and the delay times dR of the delay elements ZR1 to ZRn are gradually increased from 0 sec. in a step of τ sec. In the same manner as described above, when the delay times dL of the delay elements ZL1 to ZLn are fixed to (m−1)×τ sec. and the delay times dR of the delay elements ZR1 to ZRn are gradually increased from 0 sec. in a step of τ sec., the interaural correlation coefficients and the differences shown in FIG. 6D are finally obtained.

Then, the differences [Tj−Cij] which are obtained when the delay times dL are set to τ, 2×τ, . . . , (m−1)×τ are stored into the storage regions Q2, Q3, . . . , Qm, so that all the storage regions Q1, Q2, . . . , Qm finally store the differences [Tj−Cij] corresponding to the delay times dL and dR as shown in FIG. 7A.

If it is judged in step S124 that the variable q is m or q=m (Yes), the optimum delay times of the delay elements ZL1 to ZLn and ZR1 to ZRn are judged and set in step S128. The judging and setting processes are performed in the following manner.

In the differences [Tj−Cij] shown in FIG. 7A and stored in the storage region Q1 to Qm, first, the minimum value is detected from the differences [T1−Cil] corresponding to the first (j=1) delay elements ZL1 and ZR1, and the delay times dL and dR of the delay elements ZL1 and ZR1 corresponding to the minimum value are judged and set as the optimum delay times.

When, in the differences [T1−Cil] corresponding to the column of j=1 in FIG. 7A, the difference (T1−C31) in the case where the delay times are dL=τ and dR=2×τ is minimum, for example, τ is judged as the optimum delay time of the delay element ZL1, 2×τ is judged as the optimum delay time of the delay element ZR1, and the optimum delay times are set as shown in FIGS. 7B and 7C.

Similarly, when, in the differences [T2−Ci2] corresponding to the column of j=2 in FIG. 7A, the difference (T2−C22) in the case where the delay times are dL=(m−1)×τ and dR=τ is minimum, (m−1)−τ is judged as the optimum delay time of the delay element ZL2, τ is judged as the optimum delay time of the delay element ZR2, and the optimum delay times are set as shown in FIGS. 7B and 7C.

Similarly, when, in the differences [T3−Ci3] corresponding to the column of j=3 in FIG. 7A, the difference (T3−C23) in the case where the delay times are dL=0 and dR=τ is minimum, 0 is judged as the optimum delay time of the delay element ZL3, τ is judged as the optimum delay time of the delay element ZR3, and the optimum delay times are set as shown in FIGS. 7B and 7C.

The optimum delay times of the other delay elements are judged and set in the same manner. When, in the differences [Tn−Cin] corresponding to the column of j=n in FIG. 7A, the difference (Tn−Cln) in the case where the delay times are dL=2×τ and dR=0 is minimum, for example, 2×τ is judged as the optimum delay time of the delay element ZLn, 0 is judged as the optimum delay time of the delay element ZRn, and the optimum delay times are set as shown in FIGS. 7B and 7C.

When the delay times of the delay elements ZL1 to ZLn and ZR1 to ZRn are adjusted to the optimum values in this way, the control proceeds to the process shown in FIG. 3 and of adjusting the attenuation factors of the digital attenuators ATL1 to ATLn and ATR1 to ATRn.

Steps S206 to S228 of FIG. 3 correspond to steps S106 to S128 of FIG. 2. Namely, the attenuation factors of the digital attenuators ATL1 to ATLn and ATR1 to ATRn are adjusted by processes similar to the above-described processes of obtaining the optimum delay times of the delay elements ZL1 to ZLn and ZR1 to ZRn.

In FIG. 3, the variable r designates the p number of storage regions Q1 to Qp, and indicates the order in the case where the attenuation factors of the digital attenuators ATL1 to ATLn of the delaying circuit 19 are changed in a step of a predetermined value (−G) (decibels). The variable i indicates the order in the case where the attenuation factors of the digital attenuators ATR1 to ATRn of the delaying circuit 20 are changed in a step of the predetermined value (−G) (decibels).

In steps S206 to S226, the processes are performed while the delay elements ZL1 to ZLn and ZR1 to ZRn are set to the above-mentioned optimum delay times, the attenuation factors AL of the digital attenuators ATL1 to ATLn are sequentially changed correspondingly with the variable r or to 0, −G, −2×G, . . . , −(m−1)×G, and the attenuation factors AR of the digital attenuators ATR1 to ATRn are sequentially changed correspondingly with the variable i or to 0, −G, −2×G, . . . , −(m−1)×G.

As a result, the interaural correlation coefficients Cij and the differences [Tj−Cij] associated with the attenuation factors AL and AR are calculated. The differences [Tj−Cij] are stored into the storage regions Q1 to Qp with being associated with the attenuation factors AL and AR as shown in FIG. 8A.

In step S228, on the basis of the differences [Tj−Cij] stored in the storage regions Q1 to Qp, the optimum attenuation factors of the digital attenuators ATL1 to ATLn and ATR1 to ATRn are judged and set.

The optimum attenuation factors of the digital attenuators ATL1 to ATLn and ATR1 to ATRn are judged in the following manner.

In the differences [Tj−Cij] shown in FIG. 8A and stored in the storage region Q1 to Qp, first, the minimum value is detected from the differences [T1−Cil] corresponding to the first (j=1) digital attenuators ATL1 and ATR1, and the attenuation factors AL and AR of the digital attenuators ATL1 and ATR1 corresponding to the minimum value are judged and set as the optimum attenuation factors.

When, in the differences [T1−Ci1] corresponding to the column of j=1 in FIG. 8A, the difference (T1−Cp1) in the case where the attenuation factors are AL=0 and AR=−(p−1)×G is minimum, for example, 0 is judged as the optimum attenuation factor of the digital attenuator ATL1, −(p−1)×G is judged as the optimum attenuation factor of the digital attenuator ATR1, and the optimum attenuation factors are set as shown in FIGS. 8B and 8C.

Similarly, when, in the differences [T2−Ci2] corresponding to the column of j=2 in FIG. 8A, the difference (T2−C32) in the case where the attenuation factors are AL=−2×G and AR=−2×G is minimum, −2×G is judged as the optimum attenuation factor of the digital attenuator ATL2, −2×G is judged as the optimum attenuation factor of the digital attenuator ATR2, and the optimum attenuation factors are set as shown in FIGS. 8B and 8C.

Similarly, when, in the differences [T3−Ci3] corresponding to the column of j=3 in FIG. 8A, the difference (T3−C23) in the case where the attenuation factors are AL=−(p−1)×G and AR=−G is minimum, −(p−1)×G is judged as the optimum attenuation factor of the digital attenuator ATL3, −G is judged as the optimum attenuation factor of the digital attenuator ATR3, and the optimum attenuation factors are set as shown in FIGS. 8B and 8C.

The optimum attenuation factors of the other digital attenuators are judged and set in the same manner. When, in the differences [Tn−Cin] corresponding to the column of j=n in FIG. 8A, the difference (Tn−C2n) in the case where the attenuation factors are AL=0 and AR=−G is minimum, 0 is judged as the optimum attenuation factor of the digital attenuator ATLn, −G is judged as the optimum attenuation factor of the digital attenuator ATRn, and the optimum attenuation factors are set as shown in FIGS. 8B and 8C.

When the attenuation factors of all the digital attenuators ATL1 to ATLn and ATR1 to ATRn have been adjusted by the process of step S228, the operation of the noise generator 2000 is stopped, and the input audio signals SL and SR are enabled to be input, thereby completing the sound field adjustment process.

As described above, in the embodiment, the attenuation factors of the attenuator circuits 17 and 18, and the delay times of the delaying circuits 19 and 20 are set so as to approximate the interaural correlation coefficient τRL which is actually acquired from the reproduced sounds, to the interaural correlation coefficient τRL' of a specific concert hall or the like. When the speakers 25 and 26 are caused to generate sounds on the basis of the input audio signals SL and SR after the sound field adjustment, a reproduction sound field where spatial sound impression similar to that in the specific concert hall is obtained can be generated even in the living room or the like of the user (listener).

In the related art, in the sound field adjustment, speakers are caused to generate sounds by passing a stationary random signal of the narrow band through the band pass filters which are set to a narrow band, and an actual interaural correlation coefficient is obtained from reproduced sounds which are generated by the sounding. Consequently, there may arise a case where an approximation error occurs when a reproduction sound field in a listening room of the listener or the like is approximated to an interaural correlation coefficient of a concert hall or the like.

In contrast to the related art, in the embodiment, the uncorrelated noises SNZ of the whole audio frequency band are used as the input signal for adjustment, and the uncorrelated noises SNZ are passed through all of the band pass filters BFL1 to BFLn and BFR1 to BFRn, the digital attenuators ATL1 to ATLn and ATR1 to ATRn, and the digital delay elements ZL1 to ZLn and ZR1 to ZRn, and then supplied to the speakers 25 and 26. On the basis of the test data DL1(t) to DLn(t) and DR1(t) to DRn(t) which are obtained by band-splitting the reproduced sounds generated by the supply, by the band-split digital band pass filters BFL1' to BFLn' and BFR1' to BFRn', the actual interaural correlation coefficient τRL is obtained.

When the actual interaural correlation coefficient ρRL is obtained on the basis of the test data DL1(t) to DLn(t) and DR1(t) to DRn(t) which are obtained by performing band-splitting by the band-split digital band pass filters BFL1' to BFLn' and BFR1' to BFRn' that are identical with the band pass filters BFL1 to BFLn and BFR1 to BFRn, the interaural correlation coefficient ρRL is actually obtained under the same conditions as those in usual reproduction in which the speakers 25 and 26 are caused to generate sounds by the input audio signals SL and SR.

When the attenuation factors of the digital attenuators ATL1 to ATLn and ATR1 to ATRn and the delay times of the delay elements ZL1 to ZLn and ZR1 to ZRn are set so as to approximate the interaural correlation coefficient ρRL to the target interaural correlation coefficient ρRL' of a concert hall or the like, the approximation error can be largely reduced, so that the target sound field where spatial sound impression simulating that in a specific concert hall or the like is obtained can be generated.

In the embodiment, the uncorrelated noises SNZ are used as the input signal in the adjustment. The invention is not restricted to this. As the input signal, any appropriate signal may be used as far as the signal has signal components over the whole audio frequency band.

In the embodiment, the filter circuits 15 and 16, the attenuator circuits 17 and 18, the delaying circuits 19 and 20, and the adders 21 to 24 are disposed in the input lines CHL and CHR for two channels. Alternatively, a filter circuit, an attenuator circuit, a delaying circuit, and an adder may be disposed only in one of the input lines.

For example, a configuration in which the filter circuit 16, the attenuator circuit 18, the delaying circuit 20, and the adder 22 are omitted, the outputs of the amplifiers 33 and 34 are supplied to the adder 23, and the output of the adder 21 and that of the amplifier 34 are supplied to the adder 24 may be employed. Also in the configuration, a sound field where spatial sound impression is obtained can be generated by reproduced sounds released from the speakers 25 and 26.

In the embodiment described above, in normal audio reproduction, the left and right or two-channel input audio signals SL and SR are supplied to enable the speakers 25 and 26 to perform stereophonic reproduction. The invention is not restricted to this. Even when a monophonic audio signal is supplied as the audio signals SL and Sr, a reproduction sound field where spatial sound impression is obtained can be generated.

In the embodiment, the two-channel stereophonic audio system has been described. The invention can be applied also to a so-called multi-channel audio system having a larger number of channels.

In the embodiment, as described above, the speakers 25 and 26 are caused to generate sounds in the sound field adjustment, the interaural correlation coefficient is acquired on the basis of the reproduced sounds which are actually modulated by the transfer functions (frequency characteristics) H11, H12, H21, and H22 of the spaces such as the living room of the user, and the attenuation factors of the digital attenuators ATL1 to ATLn and ATR1 to ATRn, and the delay times of the delay elements ZL1 to ZLn and ZR1 to ZRn are optimized on the basis of the interaural correlation coefficient.

Alternatively, the speakers 25 and 26 may not be caused to generate sounds, and the reproduced sounds which are modulated by the transfer functions H11, H12, H21, and H22 of the living room or the like may not be picked up. In the alternative, transfer function data [H] in the form of a regular matrix and indicative of the transfer functions H11, H12, H21, and H22 of the space such as the living room may be previously stored in a predetermined storage region of the control section 32, and the attenuation factors of the digital attenuators ATL1 to ATLn and ATR1 to ATRn, and the delay times of the delay elements ZL1 to ZLn and ZR1 to ZRn may be optimized by simulation.

Figure 9:
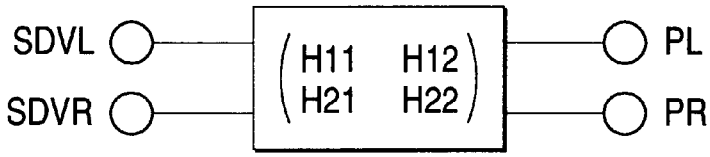
FIG. 9 is a view schematically showing a transfer function of a reproduction sound field.
Figure 10A:
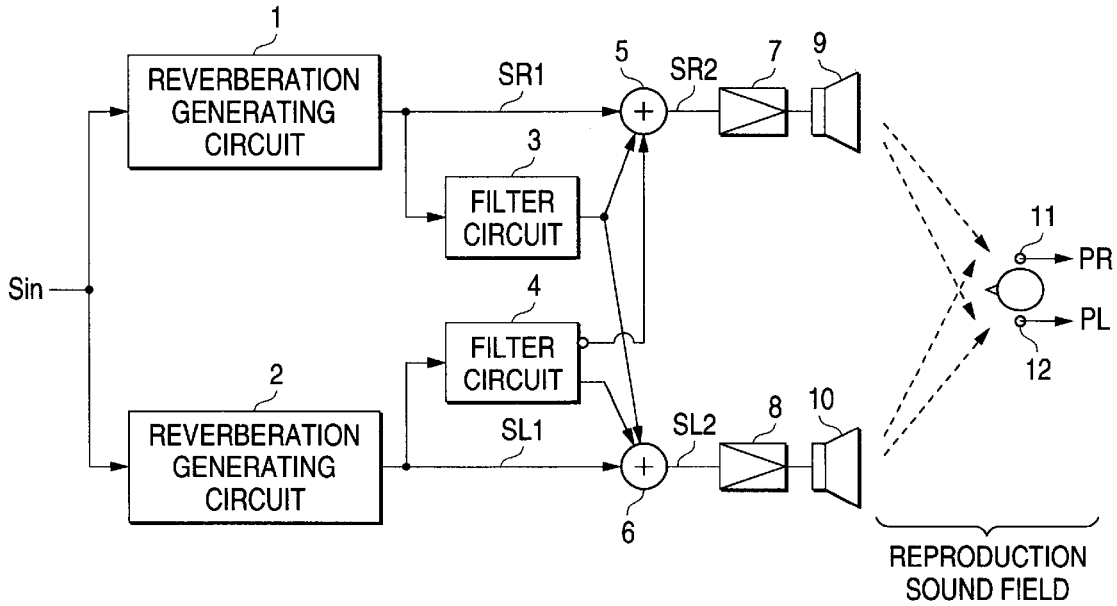
FIG. 10 are a view showing the configuration of a sound field generation system according to related art.
Figure 10B:
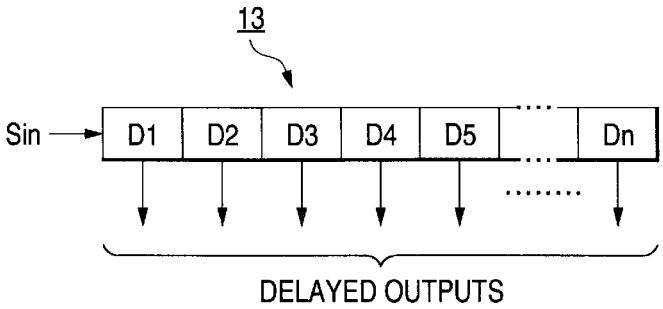
Figure 10C:
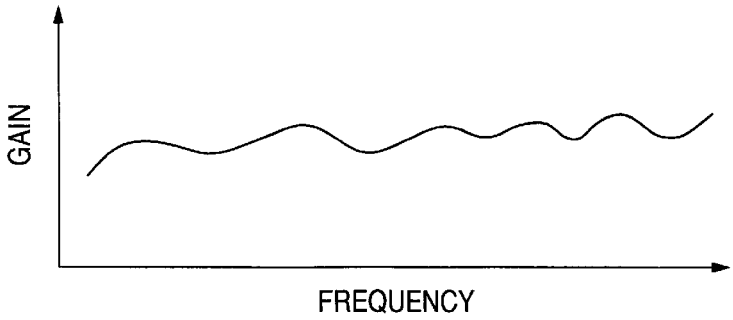
Figure 11A:
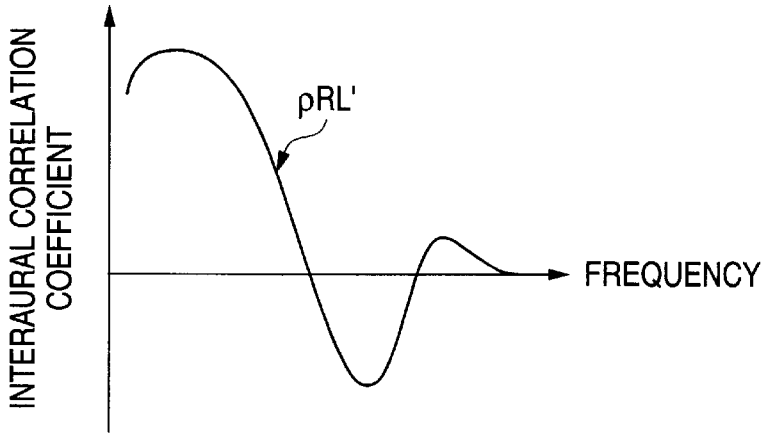
FIG. 11 are a view illustrating a problem of the sound field generation system according to related art.
Figure 11B:
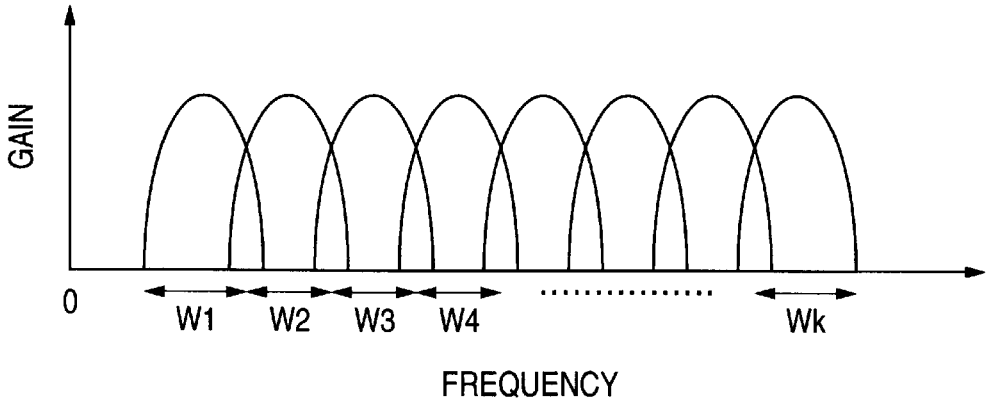
Figure 11C:
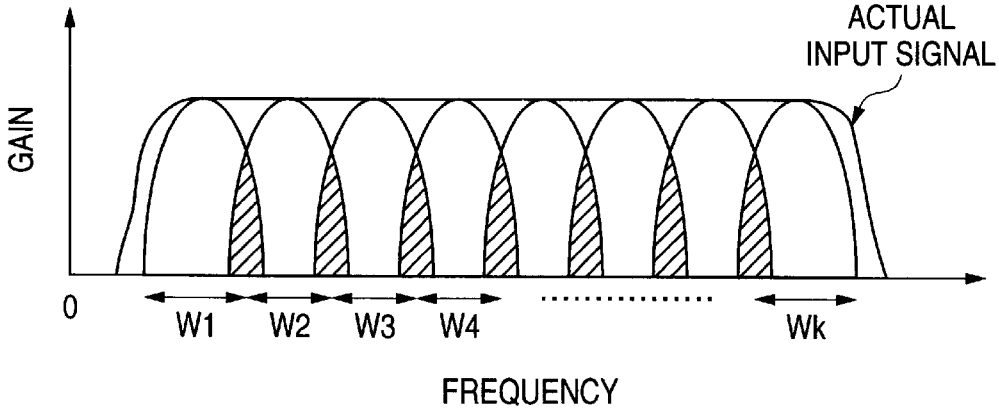

Specifically, a first modification of the embodiment may be configured in the following manner. In the sound field adjustment process which has been described with reference to FIGS. 2 and 3, when the attenuation factors of all the digital attenuators ATL1 to ATLn and ATR1 to ATRn are set to 0 dB and the delay times of all the delay elements ZL1 to ZLn and ZR1 to ZRn are set to 0 sec., the frequency characteristics of the signals SDVL and SDVR supplied to the speakers 25 and 26, and the pick-up signals PL and PR picked-up by the microphones 27 and 28 are calculated. Based on results of these calculations, a transfer function [H] of the space configured by the speakers 25 and 26, the living room, and the like is acquired, and the data [H] of the transfer function are stored in a predetermined storage region of the control section 32. Namely, transfer function data [H] such as shown in FIG. 9 are previously stored.

When, after the first sound field adjustment process is performed, the user gives instructions for again performing sound field adjustment with designating another concert hall or the like, the output signals SDVL and SDVR of the adders 23 and 24 are not supplied to the speakers 25 and 26, and the pick-up signals PL and PR are calculated by simulation based on Ex. (2) below. In other words, pseudo pick-up signals PL and PR are acquired by simulation.

Furthermore, test data DL1(t) to DLn(t) and DR1(t) to DRn(t) are calculated by applying the calculated pick-up signals PL and PR to the filter circuits 29 and 30. The interaural correlation coefficients Cij and the differences [Tj−Cij] are calculated on the basis of the test data DL1(t) to DLn(t) and DR1(t) to DRn(t). Then, the attenuation factors of the digital attenuators ATL1 to ATLn and ATR1 to ATRn, and the delay times of the delay elements ZL1 to ZLn and ZR1 to ZRn are optimized on the basis of the differences [Tj−Cij].

Namely, when instructions for again performing sound field adjustment are given, the output signals SDVL and SDVR of the adders 23 and 24 are not supplied to the speakers 25 and 26, the pseudo pick-up signals PL and PR are calculated by simulation based on Ex. (2) below, and the pick-up signals PL and PR which are acquired by the calculation are used as the actual pick-up signals to be applied to the filter circuits 29 and 30.

$$\begin{pmatrix} PL \\ PR \end{pmatrix} = \begin{pmatrix} H11 & H12 \\ H21 & H22 \end{pmatrix} \begin{pmatrix} SDVL \\ SDVR \end{pmatrix} \tag{2}$$

In this way, after the transfer function data [H] of the space configured by the speakers, the living room, and the like are once acquired, sound field adjustment is performed by simulation using the transfer function data [H]. According to this configuration, it is not required to cause the speakers 25 and 26 to generate sounds each time when sound field adjustment is to be performed, and hence improvement of convenience of the user and the like can be enabled.

In the first modification described above, the pseudo pick-up signals PL and PR which are acquired by the simulation are applied to the filter circuits 29 and 30 to further acquire the test data DL1(t) to DLn(t) and DR1(t) to DRn(t). Alternatively, transfer function data [H] including the frequency characteristics of the space of the living room and the like and those of the filter circuits 29 and 30 may be previously stored, the output signals SDVL and SDVR of the adders 23 and 24 may be applied to the transfer function data [H] to directly acquire test data DL1(t) to DLn(t) and DR1(t) to DRn(t), and the interaural correlation coefficient may be calculated on the basis of the test data DL1(t) to DLn(t) and DR1(t) to DRn(t).

In a second modification of the embodiment, transfer function data [H] of the space configured by the speakers 25 and 26, the living room of the user, and the like are previously stored in a predetermined storage region of the control section 32. When the user gives instructions for performing sound field adjustment with designating a desired concert hall or the like, the pick-up signals PL and PR may be calculated from the beginning by simulation based on Ex. (2) above. The pick-up signals PL and PR which are acquired by the calculation may be used as the actual pick-up signals to be applied to the filter circuits 29 and 30.

In the first modification, the speakers 25 and 26 are caused to generate sounds in the first sound field adjustment. By contrast, in the second modification, sound field adjustment is performed without causing the speakers 25 and 26 to generate sounds, and by only simulation using the transfer function data [H] which are previously stored.

In the second modification, plural kinds of transfer function data [H] in which housing conditions and the like are considered are previously stored into the control section 32 at the factory shipment, and the user selectively designates a transfer function suitable for the living room or the like of the user, from the plural kinds of transfer functions by using a remote controller or the like.

According to the second modification, improvement of convenience of the user and the like can be enabled, and a reproduction sound field where the user can receive spatial sound impression similar to that obtained in the case where the user listens to music in a desired concert hall can be provided simply by selectively designating a transfer function suitable for the living room or the like of the user. Furthermore, the microphones 27 and 28 shown in FIG. 1 can be eliminated.

In the second modulation also, in place of applying the pseudo pick-up signals PL and PR which are acquired by the simulation to the filter circuits 29 and 30 to further acquire the test data DL1(t) to DLn(t) and DR1(t) to DRn(t), transfer function data [H] including the frequency characteristics of the space of the living room and the like and those of the filter circuits 29 and 30 may be previously stored, the output signals SDVL and SDVR of the adders 23 and 24 may be applied to the transfer function data [H] to directly acquire test data DL1(t) to DLn(t) and DR1(t) to DRn(t), and interaural correlation coefficient may be calculated on the basis of the test data DL1(t) to DLn(t) and DR1(t) to DRn(t).

As described above, in the sound field generation system of the invention, the input signal is supplied to the sound releasing units through the first band splitting units and the delaying units, and reproduced sounds are picked up. Interaural correlation is calculated on the basis of band-split outputs which are obtained by band-splitting the reproduced sounds by the second band splitting units having the same bandwidths as those of the first band splitting units. Based on a result of the calculation, the delaying amounts of the delaying units which are disposed in the first band splitting unit, respectively, are controlled. Therefore, the result of the calculation of the interaural correlation contains no influence between the split bands, and the target reproduction sound field can be realized with high accuracy.

The system is configured so that the attenuation factor adjusting units is disposed in the delaying units, respectively and the attenuation factors of the attenuation factor adjusting units are controlled on the basis of the calculation result of the calculating unit. The delaying amount and amplitude controls are conducted on the input signal of the respective bands set by the first band splitting units. Therefore, the target reproduction sound field can be generated with higher accuracy.

The system further comprises the storage unit for storing data indicative of transfer functions of spaces between the sound releasing unit and listening positions at which reproduced sounds output from the sound releasing units are received, and which correspond to the ears, respectively. By simulation, the signal supplied from the input lines toward the sound releasing units is subjected to a modulation process on the basis of data indicative of the transfer functions, to acquire modulated data corresponding to the reproduced sounds at the listening positions, interaural correlation at the listening positions is calculated on the basis of the modulated data, and delaying amounts of the delaying units are controlled on the basis of a result of the calculation. Even when sounds released from the sound releasing units are not actually picked up by sound picking units such as microphones, therefore, the delaying amounts of the delaying units can be optimized.

When a process of correcting a sound field is performed by simulation in this way, it is possible to attain effects such as that improvement of convenience of the user and the like can be enabled, and that a sound field where the user can receive spatial sound impression similar to that obtained in the case where the user listens to music in a desired concert hall or the like can be provided simply by selectively designating a transfer function suitable for the living room or the like of the user.

Furthermore, the attenuation factor adjusting units are disposed in the delaying unit, respectively, and the attenuation factors of the attenuation factor adjusting units are controlled on the basis of the calculation result of interaural correlation at the listening positions acquired by simulation. Therefore, not only optimization of the delaying amounts in the input lines, but also optimum control of the amplitudes can be performed, so that the target reproduction sound field can be generated with higher accuracy. Moreover, improvement of convenience of the user and the like can be enabled.

What is claimed is:

1. A sound field generation system performing interaural correction on at least one input signal to generate a target reproduction sound field, comprising:

at least two sound releasing units;

two input lines through which the one input signal is supplied to the sound releasing units;

a plurality of first band splitting units which are disposed in at least one of the two input lines, and which have different bands from each other;

a plurality of delaying units which are disposed in the first band splitting units, respectively;

a sound picking unit adapted to pick up sounds released from the sound releasing units, at listening positions corresponding to both ears;

a plurality of second band splitting units adapted to band-split outputs of the sound picking units with the same bandwidths as those of the first band splitting units;

a calculating unit adapted to calculate interaural correlation on a basis of band-split outputs from the second band splitting units; and a controlling unit adapted to control delaying amounts of the delaying units on a basis of a calculation result of the calculating unit.

2. The sound field generation system according to claim 1, wherein the sound picking unit has two input sections adapted to pick up the sounds at the listening positions, respectively.

3. The sound field generation system according to claim 1, wherein the first band splitting units corresponds to the second band splitting units in band width, repectively.

4. The sound field generation system according to claim 1, further comprising a plurality of attenuation factor adjusting units disposed in the delaying units, respectively, wherein the controlling unit controls attenuation factors of the attenuation factor adjusting units on a basis of the calculation result of the calculating unit.

5. The sound field generation system according to claim 1, wherein the one input signal is a signal of the whole audio frequency band.

6. The sound field generation system according to claim 1, wherein the calculating unit controls the delaying amounts of the delaying units so as to approximate an interaural correlation coefficient obtained by the interaural correlation, to a target interaural correlation coefficient.

7. The sound field generation system according to claim 4, wherein the calculating unit controls the attenuation factors of the attenuation factor adjusting units so as to approximate an interaural correlation coefficient obtained by the interaural correlation, to a target interaural correlation coefficient.

8. A sound field generation system performing interaural correction on at least one input signal to generate a target reproduction sound field, comprising:

at least two sound releasing units;

two input lines through which the one input signal is supplied to the sound releasing units;

a plurality of first band splitting units which are disposed in at least one of the two input lines, and which have different bands from each other;

a plurality of delaying units which are disposed in the first band splitting units, respectively;

a storage unit adapted to store transfer functions of spaces between the sound releasing units and listening positions at which reproduced sounds output from the sound releasing units are received, and which correspond to both ears, respectively;

a calculating unit adapted to perform a modulation process on the signal supplied from the input lines toward the sound releasing units on a basis of data indicative of the transfer functions, thereby generating modulated data corresponding to the reproduced sounds at the listening positions, the calculating unit adapted to calculate interaural correlation at the listening positions on a basis of the modulated data; and a controlling unit adapted to control delaying amounts of the delaying units on a basis of a calculation result of the calculating unit.

9. The sound field generation system according to claim 8, further comprising a plurality of attenuation factor adjusting units disposed in the delaying means, respectively, wherein the controlling unit controls attenuation factors of the attenuation factor adjusting units on a basis of the calculation result of the calculating unit.

10. The sound field generation system according to claim 8, wherein the one input signal is a signal of the whole audio frequency band.

11. The sound field generation system according to claim 8, wherein the calculating unit controls the delaying amounts of the delaying units so as to approximate an interaural correlation coefficient obtained by the interaural correlation, to a target interaural correlation coefficient.

12. The sound field generation system according to claim 9, wherein the calculating unit controls the attenuation factors of the attenuation factors adjusting units so as to approximate an interaural correlation coefficient obtained by the interaural correlation, to a target interaural correlation coefficient.

* * * * *